US009381734B2

(12) United States Patent
Kamoda

(10) Patent No.: US 9,381,734 B2
(45) Date of Patent: Jul. 5, 2016

(54) SECURITIES PRINTER

(75) Inventor: Hiroyoshi Kamoda, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 13/993,735

(22) PCT Filed: Nov. 29, 2011

(86) PCT No.: PCT/JP2011/077462

§ 371 (c)(1),
(2), (4) Date: Aug. 15, 2013

(87) PCT Pub. No.: WO2012/081389

PCT Pub. Date: Jun. 21, 2012

(65) Prior Publication Data

US 2013/0312625 A1 Nov. 28, 2013

(30) Foreign Application Priority Data

Dec. 14, 2010 (JP) ..... 2010-277832
Nov. 14, 2011 (JP) ..... 2011-248391

(51) Int. Cl.
*B41F 11/02* (2006.01)
*B41F 9/02* (2006.01)
(Continued)

(52) U.S. Cl.
CPC . *B41F 9/002* (2013.01); *B41F 7/06* (2013.01); *B41F 9/021* (2013.01); *B41F 11/02* (2013.01); *B41F 21/10* (2013.01); *B41P 2227/60* (2013.01)

(58) Field of Classification Search
CPC ..... B41F 11/02; B41F 9/002; B41F 9/02; B41F 9/021; B41F 21/10; B41P 2227/60
USPC ..... 101/150–155, 217, 229, 231, 232, 170, 101/181, 211, DIG. 43
See application file for complete search history.

(56) References Cited

U.S. PATENT DOCUMENTS 4,056,056 A * 11/1977 Giori ..... 101/152
4,552,066 A * 11/1985 Giori et al. ..... 101/152
(Continued)

FOREIGN PATENT DOCUMENTS

EP 0 503 750 A1 9/1992
JP 63-264352 A 11/1988
(Continued)

OTHER PUBLICATIONS

International Search Report issued in PCT/JP2011/077462, mailed on Feb. 7, 2012.
(Continued)

*Primary Examiner* — Leslie J Evanisko
(74) *Attorney, Agent, or Firm* — Birch, Stewart, Kolasch & Birch, LLP

(57) ABSTRACT

A printer is provided with: offset printing units (120 to 150) comprising impression cylinders (121*a* to 151*a*, 121*b* to 151*b*) for holding and transferring a sheet (101), blanket cylinders (122*a* to 152*a*, 122*b* to 152*b*) facing the impression cylinders (121*a* to 151*a*, 121*b* to 151*b*), plate cylinders (123*a* to 153*a*, 123*b* to 153*b*) facing the blanket cylinders (122*a* to 152*a*, 122*b* to 152*b*), and ink devices (124*a* to 154*a*, 124*b* to 154*b*) for supplying ink to the plate cylinders (123*a* to 153*a*, 123*b* to 153*b*); and an intaglio printing unit (180) comprising an impression cylinder (181) which receives the sheet (101) subjected to offset printing in the offset printing unit (150) and holds and transfers the sheet (101), an intaglio plate cylinder (182) facing the impression cylinder (181), ink supply means (183 to 185) for supplying ink to the intaglio plate cylinder (182), and the like.

6 Claims, 10 Drawing Sheets

(51) Int. Cl.

| | |
|---|---|
| ***B41F 9/00*** | (2006.01) |
| ***B41F 7/06*** | (2006.01) |
| *B41F 21/10* | (2006.01) |

(56) References Cited

U.S. PATENT DOCUMENTS

| | | | | |
|---|---|---|---|---|
| 5,042,378 | A | 8/1991 | Germann | |
| 5,555,804 | A | 9/1996 | Kojima | |
| 5,899,145 | A | 5/1999 | Schaede | |
| 6,272,987 | B1 | 8/2001 | Kamoda | |
| 2001/0045171 | A1 | 11/2001 | Fujishiro et al. | |
| 2001/0054364 | A1 | 12/2001 | Kusaka | |
| 2002/0002916 | A1 | 1/2002 | Sugiyama | |
| 2002/0035936 | A1 * | 3/2002 | Kamoda et al. | 101/350.1 |
| 2005/0039617 | A1 | 2/2005 | Kusaka et al. | |

FOREIGN PATENT DOCUMENTS

| | | | |
|---|---|---|---|
| JP | 64-45640 | A | 2/1989 |
| JP | 2-072952 | A | 3/1990 |
| JP | 2-187337 | A | 7/1990 |
| JP | 6-336003 | A | 12/1994 |
| JP | 7-002417 | B2 | 1/1995 |
| JP | 2722022 | A | 3/1998 |
| JP | 10-291297 | A | 11/1998 |
| JP | 11-105249 | A | 4/1999 |
| JP | 2000-62134 | A | 2/2000 |
| JP | 2000-127349 | A | 5/2000 |
| JP | 2001-225441 | A | 8/2001 |
| JP | 2001-322244 | A | 11/2001 |
| JP | 2002-001923 | A | 1/2002 |
| JP | 2002-011852 | A | 1/2002 |
| JP | 2004-34641 | A | 2/2004 |
| JP | 2007-106128 | A | 4/2007 |
| JP | 4025255 | B2 | 12/2007 |
| WO | 2012/081389 | A1 | 6/2012 |

OTHER PUBLICATIONS

Written Opinion issued in PCT/JP2011/077462, mailed on Feb. 7, 2012.

* cited by examiner

SECURITIES PRINTER

TECHNICAL FIELD

The present invention relates to a security printing press for printing banknotes such as bank bills and securities such as stock certificates and bond certificates.

BACKGROUND ART

As described for example in Patent Literature 1 listed below and the like, a security printing press employed for printing banknotes such as bank bills and securities such as stock certificates and bond certificates is one which performs offset printing of printing images of a plurality of colors simultaneously on both surfaces of a sheet, by transferring printing images of inks of the respective colors onto two blanket cylinders, which are in contact with each other, from a plurality of inking devices disposed along circumferential directions of the blanket cylinders via corresponding plate cylinders, and by causing the sheet to pass between the blanket cylinders, and which then performs intaglio printing by means of an intaglio printing plate.

CITATION LIST

Patent Literatures

Patent Literature 1: Japanese Patent Application Publication No. Hei 2-187337
Patent Literature 2: Japanese Patent Application Publication No. Hei 11-105249
Patent Literature 3: Japanese Patent Application Publication No. 2001-225441
Patent Literature 4: Japanese Patent Application Publication No. 2000-127349
Patent Literature 5: Published Japanese Translation of International Application No. Hei 7-002417
Patent Literature 6: Japanese Patent Application Publication No. 2007-106128
Patent Literature 7: Japanese Patent No. 2722022
Patent Literature 8: Japanese Patent No. 4025255

SUMMARY OF INVENTION

Technical Problem

Such a security printing press as described above, however, performs offset printing on the sheet by pressing the sheet with the blanket cylinders each having an elastic rubber blanket wound around the surface thereof. For this reason, the security printing press is incapable of performing offset printing of sharp printing images on the sheet.

In view of the above-described circumstances, an object of the present invention is to provide a security printing press capable of performing offset printing of sharp printing images on a sheet, and continuously performing intaglio printing on the sheet in line.

Solution to Problem

To solve the above-described problem, a security printing press for printing securities according to the present invention is characterized in that the security printing press comprises: an offset printing unit including an impression cylinder which holds and transports a sheet, a blanket cylinder which is in contact with the impression cylinder, a plate cylinder which is in contact with the blanket cylinder, and ink supply means for supplying ink to the plate cylinder; and an intaglio printing unit including an impression cylinder which receives the sheet subjected to offset printing in the offset printing unit and holds and transports the sheet, an intaglio cylinder which is in contact with the impression cylinder, an ink collecting cylinder which is in contact with the intaglio cylinder, a plurality of ink form cylinders which are in contact with the ink collecting cylinder, and a plurality of inking devices which are disposed to respectively correspond to the ink form cylinders and which supply ink to the corresponding ink form cylinders.

In addition, the security printing press for printing securities according to the present invention is characterized in that in the above-described security printing press, the offset printing unit includes: an offset printing section for one surface including an impression cylinder for one surface which holds and transports the sheet, a blanket cylinder for one surface which is in contact with the impression cylinder for one surface and which performs offset printing on one surface of the sheet, a plate cylinder for one surface which is in contact with the blanket cylinder for one surface, and ink supply means for one surface for supplying ink to the plate cylinder for one surface; and an offset printing section for the other surface including an impression cylinder for the other surface which is in contact with the impression cylinder for one surface of the offset printing section for one surface and which receives the sheet from the impression cylinder for one surface and holds and transports the sheet, a blanket cylinder for the other surface which is in contact with the impression cylinder for the other surface and which performs offset printing on the other surface of the sheet, a plate cylinder for the other surface which is in contact with the blanket cylinder for the other surface, and ink supply means for the other surface for supplying ink to the plate cylinder for the other surface, and each of the ink supply means for one surface of the offset printing section for one surface and the ink supply means for the other surface of the offset printing section for the other surface includes: two ink fountains; an oscillating roller; and oscillation adjusting means for adjusting oscillation of the oscillating roller.

In addition, the security printing press for printing securities according to the present invention is characterized in that the above-described security printing press further comprises at least one sheet forwarding cylinder which is disposed between the offset printing unit and the impression cylinder of the intaglio printing unit and which forwards the sheet subjected to offset printing in the offset printing unit to the impression cylinder of the intaglio printing unit.

In addition, the security printing press for printing securities according to the present invention is characterized in that in the above-described security printing press, the offset printing unit is configured as one module formed of the offset printing section for one surface and the offset printing section for the other surface, and a plurality of the offset printing units are capable of being coupled.

In addition, the security printing press for printing securities according to the present invention is characterized in that the above-described security printing press further comprises: checking means for one surface for detecting a printing condition of the one surface of the sheet, the checking means for one surface being disposed between a downstream side, in a transporting direction of the sheet, of a printing portion in the offset printing section for one surface that is located on the most downstream side in the transporting direction of the sheet and an upstream side, in the transporting direction of the sheet, of the impression cylinder of the intaglio printing unit, and checking means for the other surface for detecting a printing condition of the other surface of the sheet, the checking means for the other surface being disposed between a downstream side, in the transporting direction of the sheet, of a printing portion in the offset printing section for the other surface that is located on the most downstream side in the transporting direction of the sheet and an upstream side, in the transporting direction of the sheet, of the impression cylinder of the intaglio printing unit.

In addition, the security printing press for printing securities according to the present invention is characterized in that the above-described security printing press further comprises: plate changing means for one surface for changing a printing plate for the plate cylinder for one surface, the plate changing means for one surface being provided in the offset printing section for one surface; and plate changing means for the other surface for changing a printing plate for the plate cylinder for the other surface, the plate changing means for the other surface being provided in the offset printing section for the other surface.

Advantageous Effects of Invention

According to the security printing press of the present invention, printing is performed one surface of a sheet held on the impression cylinder for one surface by the blanket cylinder for one surface, the sheet is then gripped and held on the impression cylinder for the other surface, and printing is performed on the other surface of the sheet by the blanket cylinder for the other surface. In short, the security printing press employs alternate double-side printing. Therefore, when printing is performed on each of both surfaces of the sheet, the sheet is pressed against the blanket cylinder by the impression cylinder, making it possible to print sharp printing images on both surfaces of the sheet.

DESCRIPTION OF EMBODIMENTS

Although embodiments of a security printing press according to the present invention will be described on the basis of the drawings, the present invention is not limited to only the embodiments which are described below on the basis of the drawings.

Main Embodiment

A main embodiment of the security printing press according to the present invention will be described on the basis of FIGS. 1 to 7.

<<Overall Main Configuration>>

Figure 1:
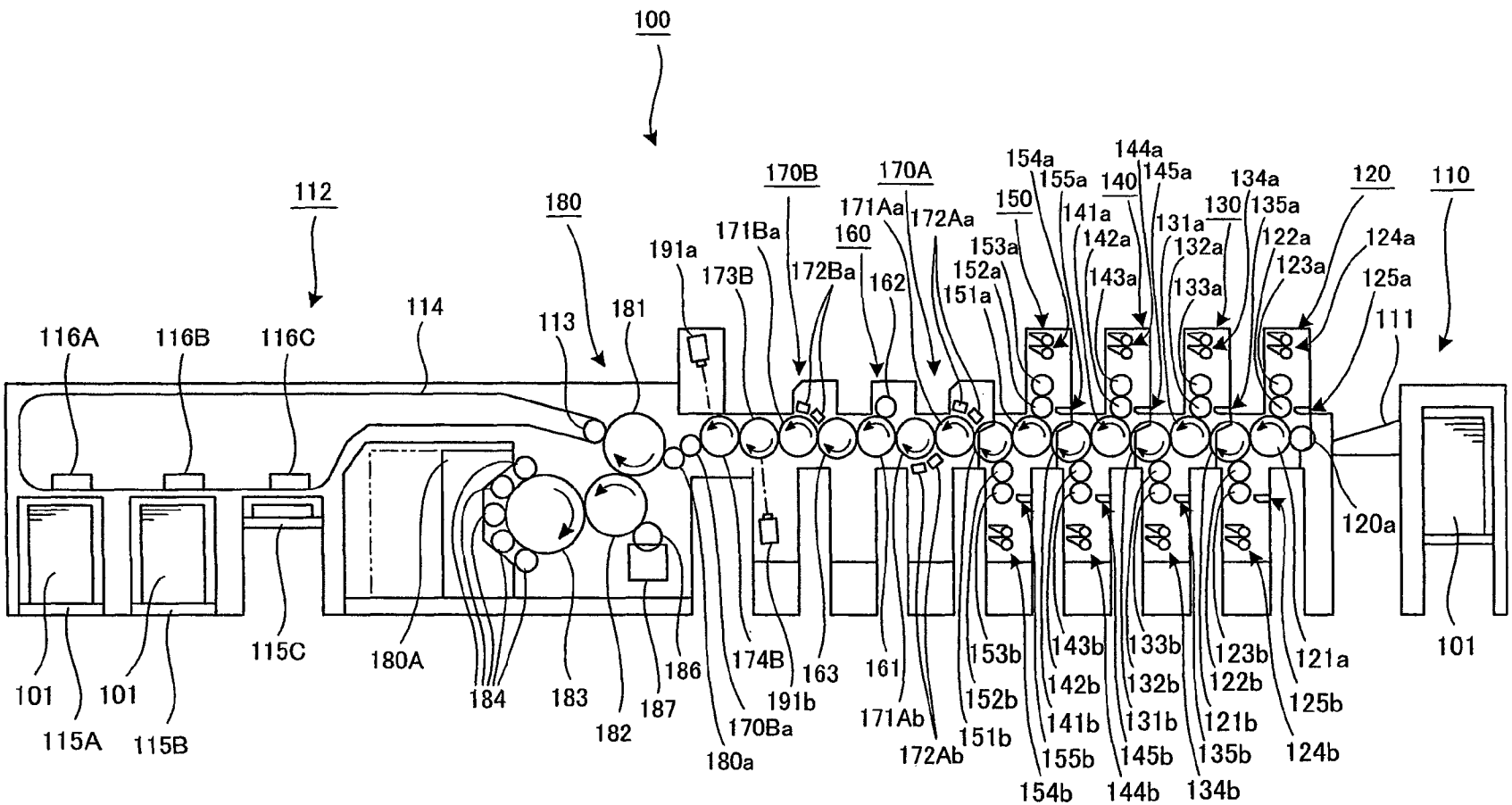
FIG. 1 is an overall schematic configuration diagram of a main embodiment of a security printing press according to the present invention.

As shown in FIG. 1, a transfer cylinder 120*a* of a first offset printing unit 120 is disposed on a leading end side of a feeder board 111 of a sheet feeding device 110, which is sheet feeding means for feeding sheets 101 one by one. The transfer cylinder 120*a* is capable of receiving the sheets 101 one by one from the feeder board 111 via an unillustrated swing arm shaft pregripper.

An impression cylinder 121*a* for one surface of the first offset printing unit 120 is in contact with the transfer cylinder 120*a* of the first offset printing unit 120. A blanket cylinder 122*a* for one surface is in contact with the impression cylinder 121*a*. A plate cylinder 123*a* for one surface is in contact with the blanket cylinder 122*a*. An inking device 124*a* for one surface, which is ink supply means for one surface, and a dampening device 125*a* for one surface, which is a dampening means for one surface, are provided to the plate cylinder 123*a*. The impression cylinder 121*a*, the blanket cylinder 122*a*, the plate cylinder 123*a*, the inking device 124*a*, the dampening device 125*a*, as described above, and the like constitute an offset printing section for one surface of the first printing unit 120.

Figure 2:
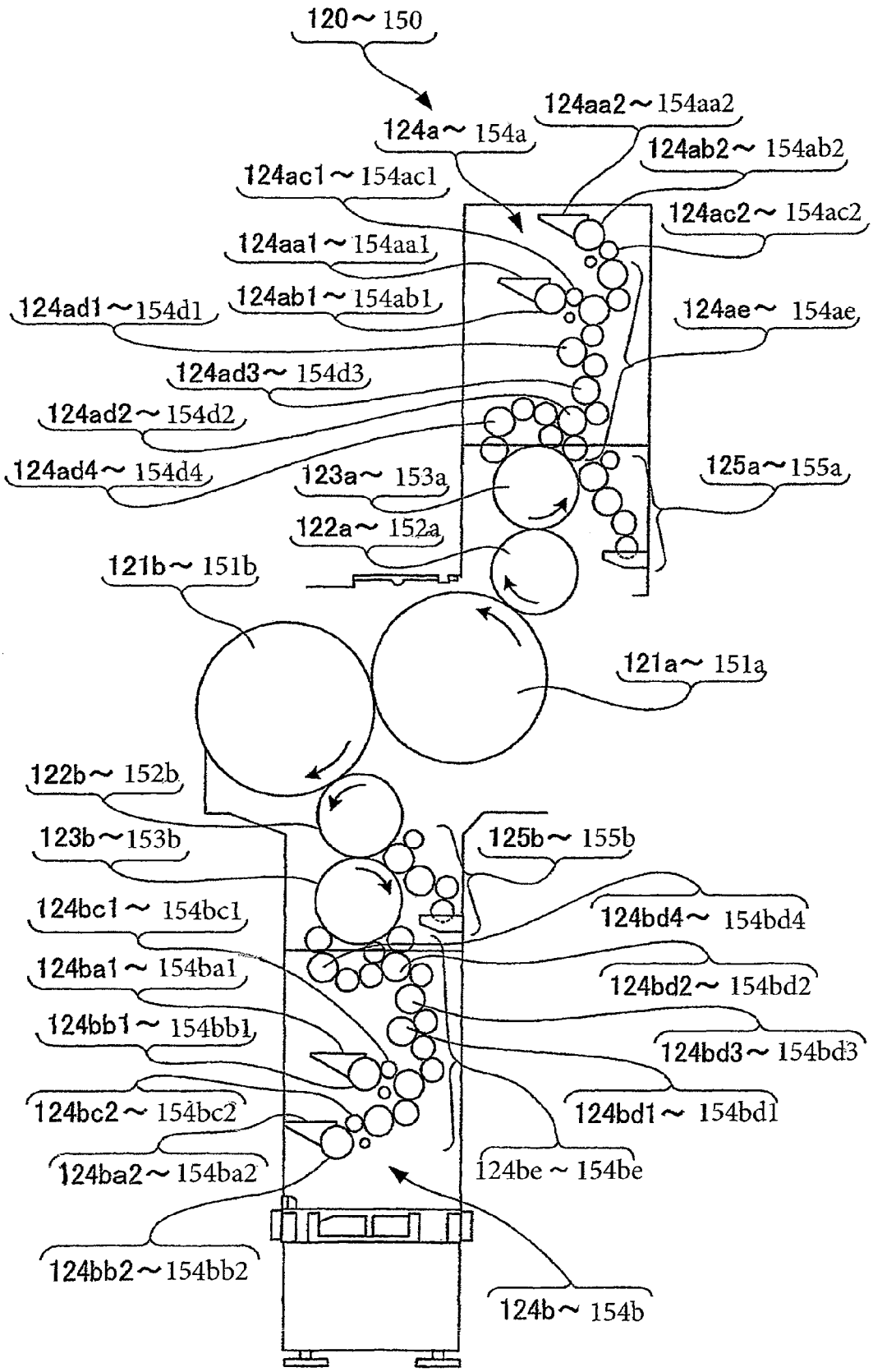
FIG. 2 is an enlarged diagram of an extracted part of an offset printing unit of the security printing press in FIG. 1.

As shown in FIG. 2, the inking device 124*a* includes: two ink fountains 124*aa*1 and 124*aa*2 which are capable of containing inks of colors different from each other; fountain rollers 124*ab*1 and 124*ab*2 which take out the ink from the respective ink fountains 124*aa*1 and 124*aa*2; ink ductor rollers 124*ac*1 and 124*ac*2 which each have a large-diameter portion and a small-diameter portion at predetermined positions in an axial direction thereof and which receive the ink taken out by the respective fountain rollers 124*ab*1 and 124*ab*2 on only the large-diameter portions; a roller train 124*ae* to which the ink is transferred from the large-diameter portions of the ink ductor rollers 124*ac*1 and 124*ac*2 and which then sends the ink to the plate cylinder 123*a*; and oscillating rollers 124*ad*1 to 124*ad*4 which are disposed between the rollers of the roller train 124*ae* and which are capable of reciprocally moving in the axial direction.

As shown in FIG. 1, an impression cylinder 121*b* for the other surface of the first offset printing unit 120 is in contact with the impression cylinder 121*a* at a position downstream of the position where the blanket cylinder 122*a* is in contact with the impression cylinder 121*a* in a rotation direction thereof. A blanket cylinder 122*b* for the other surface is in contact with the impression cylinder 121*b*. A plate cylinder 123*b* for the other surface is in contact with the blanket cylinder 122*b*. An inking device 124*b* for the other surface, which is ink supply means for the other surface, and a dampening device 125*b* for the other surface, which is dampening means for the other surface, are provided to the plate cylinder 123*b*. The impression cylinder 121*b*, the blanket cylinder 122*b*, the plate cylinder 123*b*, the inking device 124*b*, the dampening device 125*b*, as described above, and the like constitute an offset printing section for the other surface of the first offset printing unit 120.

As shown in FIG. 2, in the same manner as the inking device 124*a*, the inking device 124*b* includes: two ink fountains 124*ba*1 and 124*ba*2 which are capable of containing inks of colors different from each other; fountain rollers 124*bb*1 and 124*bb*2 which take out the ink from the respective ink fountains 124*ba*1 and 124*ba*2; ink ductor rollers 124*bc*1 and 124*bc*2 which each have a large-diameter portion and a small-diameter portion at predetermined positions in an axial direction thereof and which receive the ink taken out by the respective fountain rollers 124*bb*1 and 124*bb*2 on only the large-diameter portions; a roller train 124*be* to which the ink is transferred from the large-diameter portions of the ink ductor rollers 124*bc*1 and 124*bc*2 and which then sends the ink to the plate cylinder 123*b*; and oscillating rollers 124*bd*1 to 124*bd*4 which are disposed between the rollers of the roller train 124*be* and which are capable of reciprocally moving in the axial direction.

As shown in FIG. 1, an impression cylinder 131*a* for one surface of a second offset printing unit 130 is in contact with the impression cylinder 121*b* for the other surface of the first offset printing unit 120 at a position downstream of the position where the blanket cylinder 122*b* is in contact with the impression cylinder 121*b* in a rotation direction thereof. In the same manner as the first offset printing unit 120, the second printing unit 130 includes a blanket cylinder 132*a*, a plate cylinder 133*a*, an inking device 134*a*, a dampening device 135*a*, and the like for one surface, which constitute an offset printing section for one surface thereof, and includes a blanket cylinder 132*b*, a plate cylinder 133*b*, an inking device 134*b*, a dampening device 135*b*, and the like for the other surface, which constitute an offset printing section for the other surface thereof.

An impression cylinder 141*a* for one surface of a third offset printing unit 140 is in contact with the impression cylinder 131*b* for the other surface of the second offset printing unit 130 at a position downstream of the position where the blanket cylinder 132*b* is in contact with the impression cylinder 131*b* in a rotation direction thereof. In the same manner as the first and second printing units 120 and 130, the third offset printing unit 140 includes a blanket cylinder 142*a*, a plate cylinder 143*a*, an inking device 144*a*, and a dampening device 145*a*, and the like for one surface, which constitute an offset printing section for one surface thereof, and includes a blanket cylinder 142*b*, a plate cylinder 143*b*, an inking device 144*b*, and a dampening device 145*b* for the other surface, which constitute an offset printing section for the other surface thereof.

An impression cylinder 151*a* for one surface of a fourth offset printing unit 150 is in contact with the impression cylinder 141*b* for the other surface of the third offset printing unit 140 at a position downstream of the position where the blanket cylinder 142*b* is in contact with the impression cylinder 141*b* in a rotation direction thereof. In the same manner as the first to third offset printing units 120, 130, and 140, the fourth offset printing unit 150 includes a blanket cylinder 152*a*, a plate cylinder 153*a*, an inking device 154*a*, and a dampening device 155*a* for one surface, which constitute an offset printing section for one surface thereof, and includes a blanket cylinder 152*b*, a plate cylinder 153*b*, an inking device 154*b*, and a dampening device 145*b* for the other surface, which constitute an offset printing section for the other surface thereof.

A transport cylinder 171Aa for one surface of a first drying unit 170A is in contact with the impression cylinder 151*b* for the other surface of the fourth offset printing unit 150 at a position downstream of the position where the blanket cylinder 152*b* is in contact with the impression cylinder 151*b* in a rotation direction thereof. A dryer 172Aa for one surface, which is drying means for one surface for drying the one surface of the sheet 101 subjected to printing in the first to fourth offset printing units 120, 130, 140, and 150, is disposed near the transport cylinder 171Aa. A transport cylinder 171Ab for the other surface is in contact with the transport cylinder 171Aa at a position downstream of the position where the impression cylinder 151*b* for the other surface of the fourth offset printing unit 150 is in contact with the transport cylinder 171Aa in a rotation direction thereof. A dryer 172Ab for the other surface, which is drying means for the other surface for drying the other surface of the sheet 101 subjected to printing in the first to fourth offset printing units 120, 130, 140, and 150, is disposed near the transport cylinder 171Ab.

A screen printing unit 160 described in the aforementioned Patent Literature 3 is disposed such that an impression cylinder 161 thereof is in contact with the transport cylinder 171Ab for the other surface of the first drying unit 170A at a position downstream of the position where the transport cylinder 171Aa for one surface is in contact with the transport cylinder 171Ab in a rotation direction thereof. A rotary screen 162 is in contact with the impression cylinder 161. A transport cylinder 163 is in contact with the impression cylinder 161 at a position downstream of the position where the rotary screen 162 is in contact with the impression cylinder 161 in a rotation direction thereof.

A transport cylinder 171Ba of a second drying unit 170B is in contact with the transport cylinder 163 of the screen printing unit 160 at a position downstream of the position where the impression cylinder 161 is in contact with the transport cylinder 163 in a rotation direction thereof. A dryer 172Ba, which is drying means for drying the one surface of the sheet 101 subjected to screen printing in the screen printing unit 160, is disposed near the transport cylinder 171B.

A transport cylinder 173B is in contact with the transport cylinder 171Ba at a position downstream of the position where the transport cylinder 163 of the screen printing unit 160 is in contact with the transport cylinder 172Ba in a rotation direction thereof. A transport cylinder 174B is in contact with the transport cylinder 173B at a position downstream of the position where the transport cylinder 171Ba is in contact with the transport cylinder 173B in a rotation direction thereof. A transfer cylinder 170Ba is in contact with the transport cylinder 174B at a position downstream of the position where the transport cylinder 173B is in contact with the transport cylinder 174B in a rotation direction thereof.

An intaglio printing unit 180, which is similar to the intaglio printing press described in the aforementioned Patent Literature 4, is disposed such that a transfer cylinder 180*a* thereof is in contact with the transfer cylinder 170Ba of the drying unit 170B at a position downstream of the position where the transport cylinder 174B is in contact with the transfer cylinder 170Ba in a rotation direction thereof. An impression cylinder 181 is in contact with the transfer cylinder 180*a* at a position downstream of the position where the transfer cylinder 170Ba is in contact with the transfer cylinder 180*a* in a rotation direction thereof.

Figure 3:
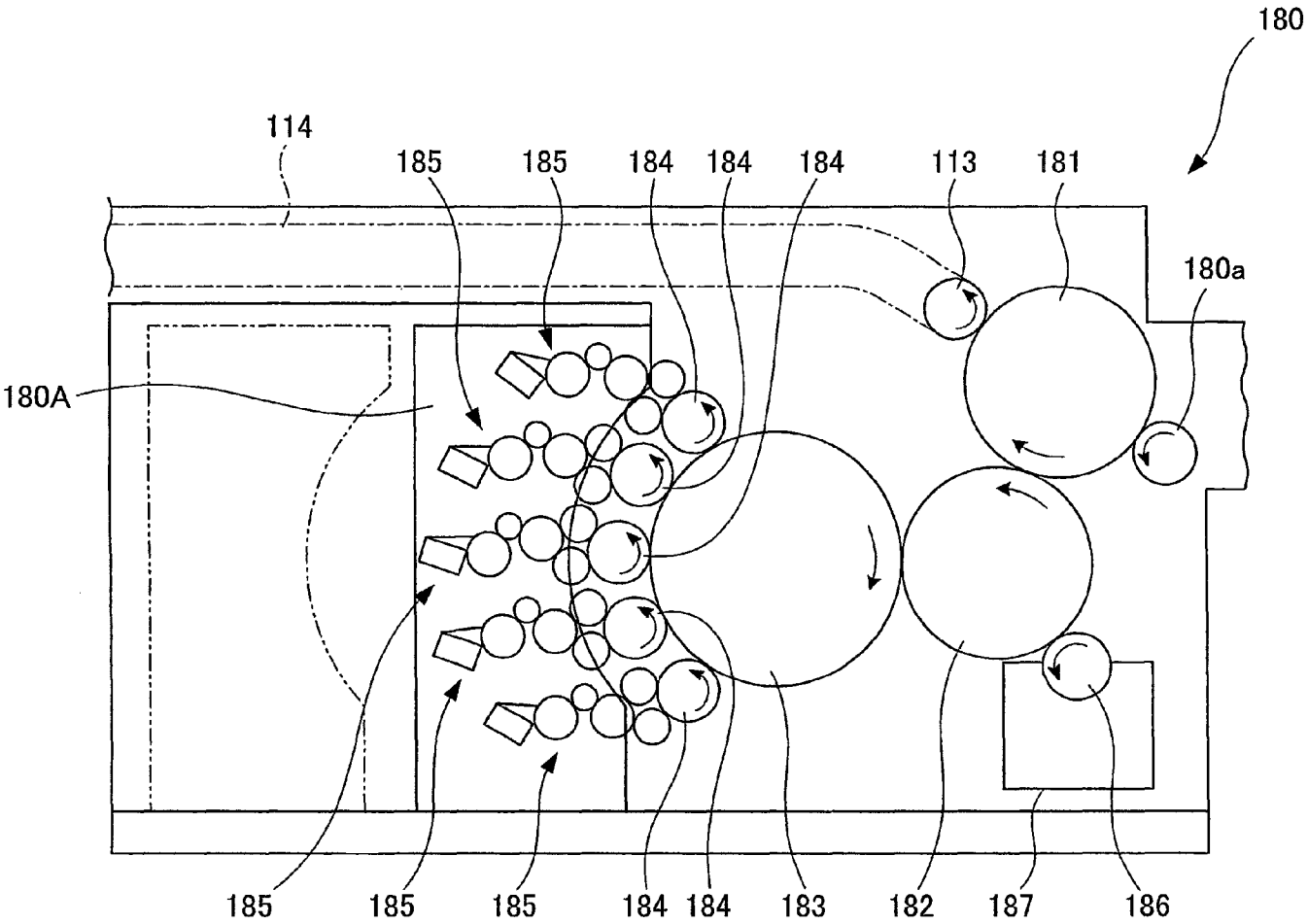
FIG. 3 is an enlarged diagram of an extracted part of an intaglio printing unit of the security printing press in FIG. 1.

As shown in FIGS. 1 and 3, an intaglio cylinder 182 is in contact with the impression cylinder 181. An ink collecting cylinder 183 is in contact with the intaglio cylinder 182. A plurality of ink form cylinders 184 (five in the embodiment) are in contact with the ink collecting cylinder 183 in such a manner as to be arranged along a circumferential direction thereof. Inking devices 185 for supplying inks are disposed on the peripheral side of these ink form cylinders 184, correspondingly. The inking devices 185 are supported in a frame 180A, which is capable of approaching and separating from the ink form cylinders 184. A wiping roller 186 is in contact with the intaglio cylinder 182. A wiping tank 187 is disposed below the wiping roller 186. Note that in the embodiment, the ink collecting cylinder 183, the ink form cylinders 184, the inking devices 185, and the like constitute ink supply means.

As shown in FIG. 1, a delivery cylinder 113 of a delivery device 112 is in contact with the impression cylinder 181 at a position downstream of the position where the intaglio cylinder 182 is in contact with the impression cylinder 181 in a rotation direction thereof. An unillustrated sprocket is provided coaxially to the delivery cylinder 113. An endless delivery chain 114 provided with a plurality of gripper bars is looped around the sprocket. A plurality of delivery piles 115A to 115C (three in the embodiment), each of which is a piling unit, are arranged in a running direction of the delivery chain 114 below the delivery chain 114.

Then, each of the first to fourth offset printing units 120, 130, 140, and 150 constitutes one module including the offset printing section for one surface and the offset printing section for the other surface in the unit, and a plurality of the units are capable of being coupled and installed. Accordingly, the maximum number of colors required for printing can be easily set by changing the number of units.

Note that in the embodiment, the impression cylinder 161 and the transport cylinder 163 of the screen printing unit 160, the transport cylinder 171Aa for one surface and the transport cylinder 171Ab for the other surface of the first drying unit 170A, the transfer cylinder 170Ba, the transport cylinder 171Ba and the transport cylinders 173B and 174B of the second drying unit 170B, and the transfer cylinder 180*a* of the intaglio printing unit 180 each constitute a sheet forwarding cylinder which forwards the sheet 101 subjected to offset printing in the offset printing units 120, 130, 140, and 150 to the impression cylinder 181 of the intaglio printing unit 180.

<<Plate Clamping Device of Plate Cylinder>>

Figure 4:
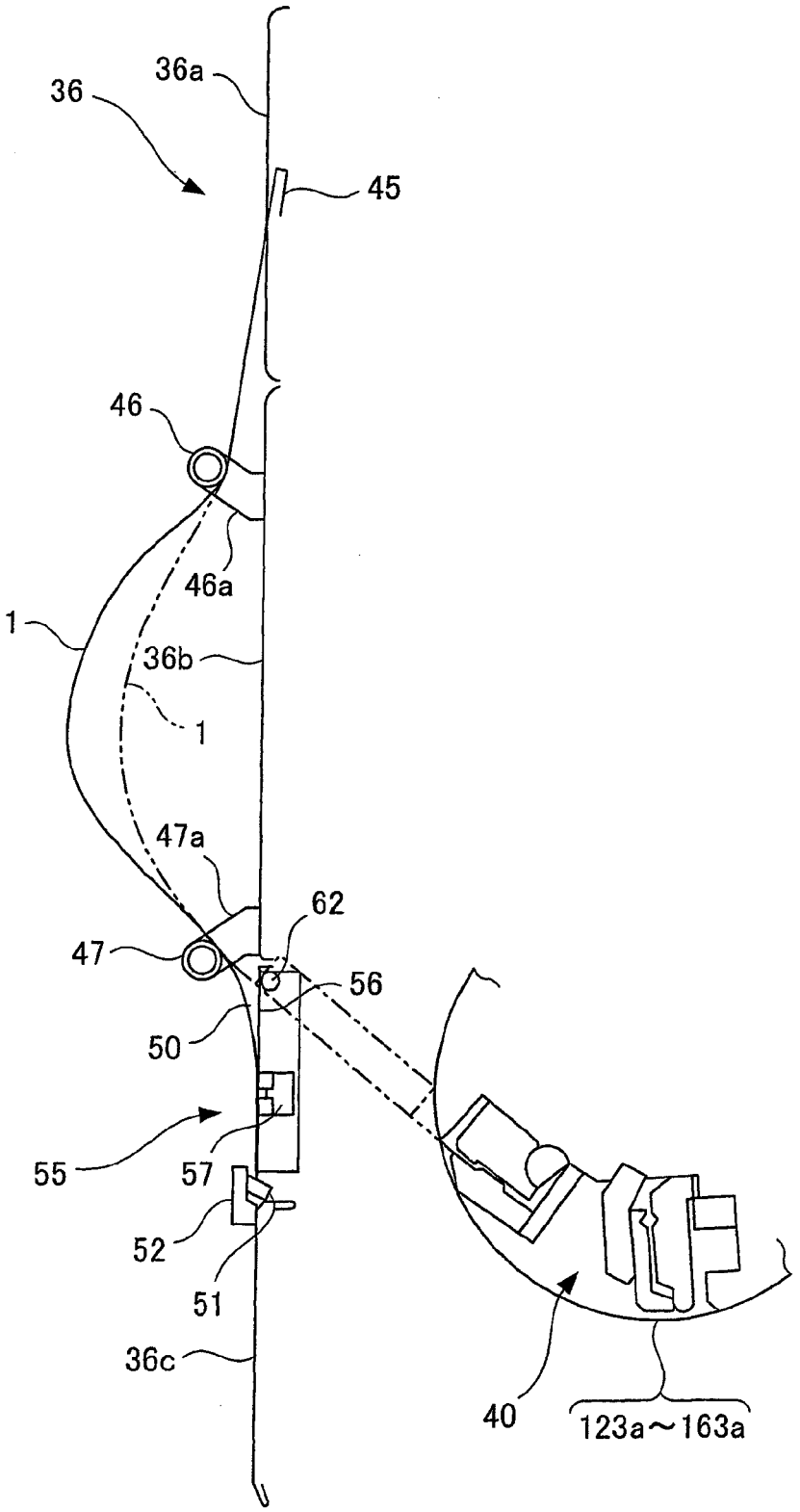
FIG. 4 is a schematic configuration diagram of a plate clamping device and a printing plate mounting device of an offset printing section for one surface of the security printing press in FIG. 1.
Figure 5:
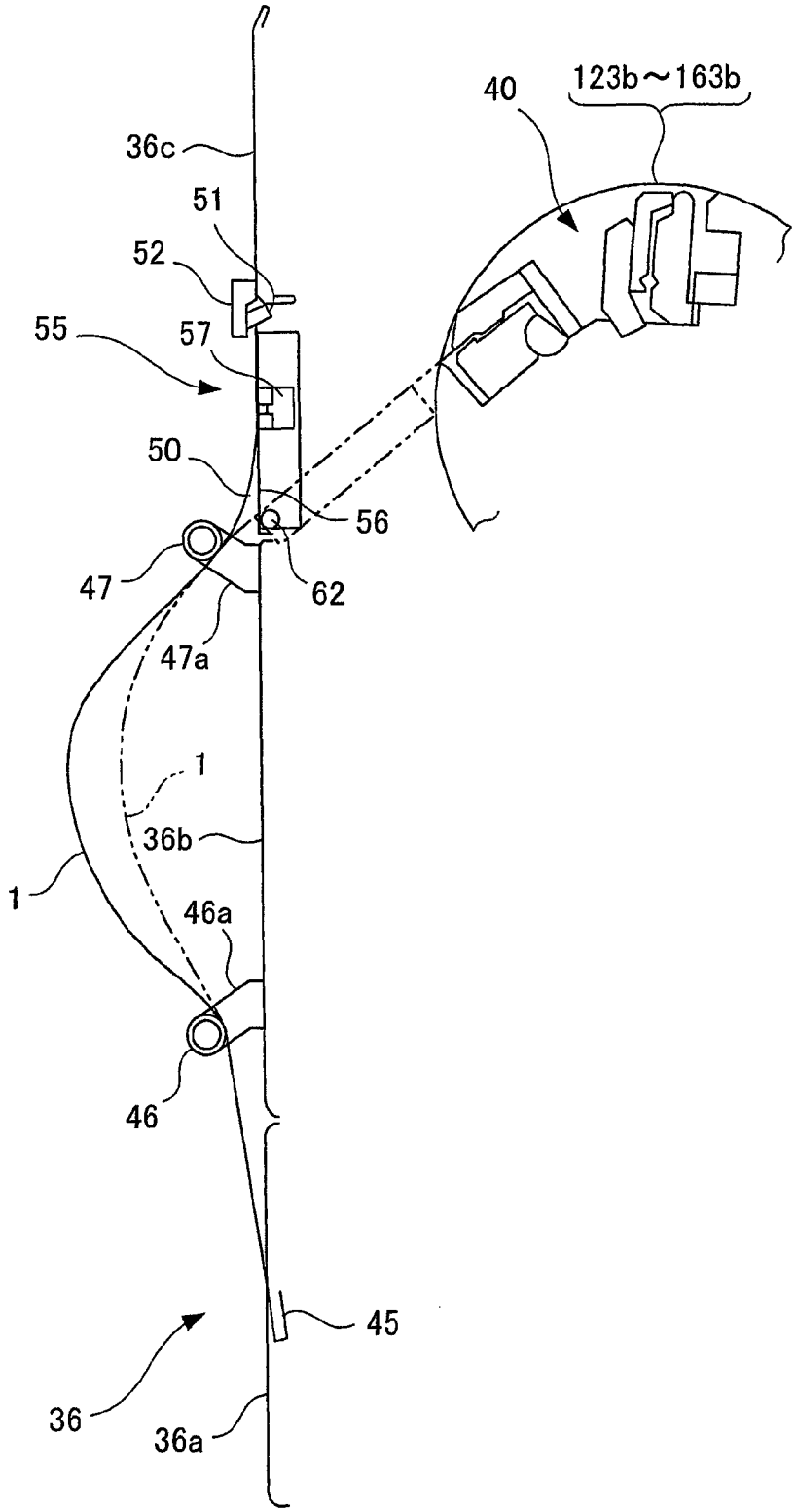
FIG. 5 is a schematic configuration diagram of a plate clamping device and a printing plate mounting device of an offset printing section for the other surface of the security printing press in FIG. 1.

In addition, as shown in FIGS. 3 and 4, the plate cylinders 123*a*, 133*a*, 143*a*, and 153*a* for one surface and the plate cylinders 123*b*, 133*b*, 143*b*, and 153*b* for the other surface of the offset printing units 120, 130, 140, and 150 each include a plate clamping device 40 described in the aforementioned Patent Literature 5. Each plate cylinder is thus capable of detachably holding a printing plate, such as a resin plate or a PS plate, on a peripheral surface of the plate cylinder by means of the plate clamping device 40.

<<Printing Plate Mounting Device>>

Moreover, the offset printing units 120, 130, 140, and 150 each include printing plate mounting devices, described in the aforementioned Patent Literatures 6 and 7 and the like, near the plate cylinders 123*a* and 123*b*, 133*a* and 133*b*, 143*a* and 143*b*, or 153*a* and 153*b*. Thus, it is possible to semi-automatically mount the printing plate on each plate cylinders 123*a*, 133*a*, 143*a*, or 153*a* for one surface via the plate clamping device 40 by means of the printing plate mounting device (plate changing means for one surface) provided near the plate cylinder 123*a*, 133*a*, 143*a*, or 153*a* while it is possible to semi-automatically mount the printing plate on each plate cylinder 123*b*, 133*b*, 143*b*, or 153*b* for the other surface via the plate clamping device 40 by means of the printing plate mounting device (plate changing means for the other surface) provided near the plate cylinder 123*b*, 133*b*, 143*b*, or 153*b*.

Specifically, as shown in FIG. 4, a locking portion 45 is provided in an upper cover 36*a* of a safety cover 36 covering a front surface of the offset printing section for one surface of each of the offset printing units 120, 130, 140, and 150. The locking portion 45 is formed in an inverted L-shape in a side view and is configured to lock an end portion of a printing plate 1 on the trailing edge side. Reference signs 46 and 47 denote a pair of guide bars each formed in a bar shape. These guide bars 46 and 47 are supported, each at two ends thereof, respectively on upper and lower sides of a middle cover 36*b* of the safety cover 36 by supporting members 46*a* and 47*a*, in parallel with an outer surface of the middle cover 36*b* at an interval therebetween, and such that the axes of the guide bars 46 and 47 extend in a width direction of the middle cover 36*b*.

A window 50 formed in a rectangle extending in a left-right direction is provided in an upper portion of a lower cover 36*c* of the safety cover 36. A pair of left and right positioning pins 51 are fixed to the lower cover 36*c* via a supporting plate 52 at positions corresponding to lower end portions of the window 50. As shown in the same drawing, the printing plate 1 is engaged with the positioning pins 51 to thus support a lower end of the printing plate 1 with the positioning pins 51 so that the printing plate 1 can be supported by the safety cover 36 before being mounted on the plate cylinder 123*a*, 133*a*, 143*a*, or 153*a*.

A plate feeding unit 55 as a swing member generally includes: a swing plate 56 which selectively covers the window 50; and a suction pad 57 which sucks the printing plate 1. A large number of holes, through which the suction pad 57 is exposed, are provided in a lower portion of the swing plate 56. The swing plate 56 is supported on the middle cover 36*b* in such a manner as to be swingable about a pivot shaft 62 implanted on the lower cover 36*c* as the turning center. The suction pad 57 is supported in such a manner as to be movable on the back surface side of the swing plate 56 along a radial direction of the pivot shaft 62, and is supplied with a suction air from an air intake pump whose illustration is omitted.

The printing plate 1 is mounted in the following manner by the printing plate mounting device configured as described above. First, the end portion to be gripped (lower end portion in the drawing) of the printing plate 1 is engaged with the positioning pins 51, so that the lower end of the printing plate 1 is supported with the positioning pins 51. Next, the upper portion and the lower portion of the printing plate 1 are placed into contact with the pair of guide bars 46 and 47. Thereafter, the upper end of the printing plate 1 is engaged with the locking portion 45, so that the printing plate 1 is supported by the safety cover 36. The printing plate 1 thus supported is bent largely in the side view between the pair of guide bars 46 and 47. In this state, the lower end portion of the printing plate 1 is sucked by the suction pad 57 of the plate feeding unit 55.

Then, the plate feeding unit 55 is turned about the pivot shaft 62 serving as the turning center in the counterclockwise direction in the drawing to bring the lower end of the plate feeding unit 55 near the plate cylinder 123*a*, 133*a*, 143*a*, or 153*a*, so that the plate feeding unit 55 is positioned at an insertion position. In this event, the movement of the plate feeding unit 55 to the insertion position is utilized to release the engagement of the printing plate 1 and the positioning pins 51. This configuration eliminates the need of dedicated drive means for moving the positioning pins 51, thus simplifying the device and reducing the manufacturing costs.

Subsequently, the suction pad 57 is moved to be brought near the plate cylinder 123*a*, 133*a*, 143*a*, or 153*a* to insert the lower end (end portion to be gripped) of the printing plate 1 into the inside, on the gripping side, of the plate clamping device 40 of the plate cylinder 123*a*, 133*a*, 143*a*, or 153*a*. Thereafter, the suction of the printing plate 1 by the suction pad 57 is released, and thereby the lower end (end portion to be gripped) of the printing plate 1, which has been held in the bending state by the suction pad 57, is pressed against the inside, on the gripping side, of the plate clamping device 40 of the plate cylinder 123*a*, 133*a*, 143*a*, or 153*a* by an elastic returning force generated by the bending, so that the printing plate 1 is positioned.

On the other hand, as shown in FIG. 4, the offset printing section for the other surface of each printing unit 120, 130, 140, or 150 is provided with a printing plate mounting device, which has a structure obtained by turning upside down the structure of the printing plate mounting device provided in the offset printing section for one surface. The printing plate mounting device of the offset printing section for the other surface is capable of operating in the same manner as that of the above-described printing plate mounting device of the offset printing section for one surface, thereby mounting the printing plate 1 on the plate cylinder 123*a*, 133*a*, 143*a*, 153*a*, or 163*a*.

<<Oscillation Adjusting Device for Oscillating Roller>>

Moreover, the oscillating rollers 124*ad*1 to 124*ad*4, 134*ad*1 to 134*ad*4, 144*ad*1 to 144*ad*4, and 154*ad*1 to 154*ad*4 of the inking devices 124*a*, 134*a*, 144*a*, and 154*a* for one surface as well as the oscillating rollers 124*bd*1 to 124*bd*4, 134*bd*1 to 134*bd*4, 144*bd*1 to 144*bd*4, and 154*bd*1 to 154*bd*4 of the inking devices 124*b*, 134*b*, 144*b*, and 154*b* for the other surface, of the printing units 120, 130, 140, and 150 are configured such that the oscillations of the oscillating rollers are adjustable for each of the inking devices 124*a*, 124*b*, 134*a*, 134*b*, 144*a*, 144*b*, 154*a*, and 154*b* of the printing units 120, 130, 140, and 150 by an oscillation adjusting device described in the aforementioned Patent Literature 8.

Figure 6:
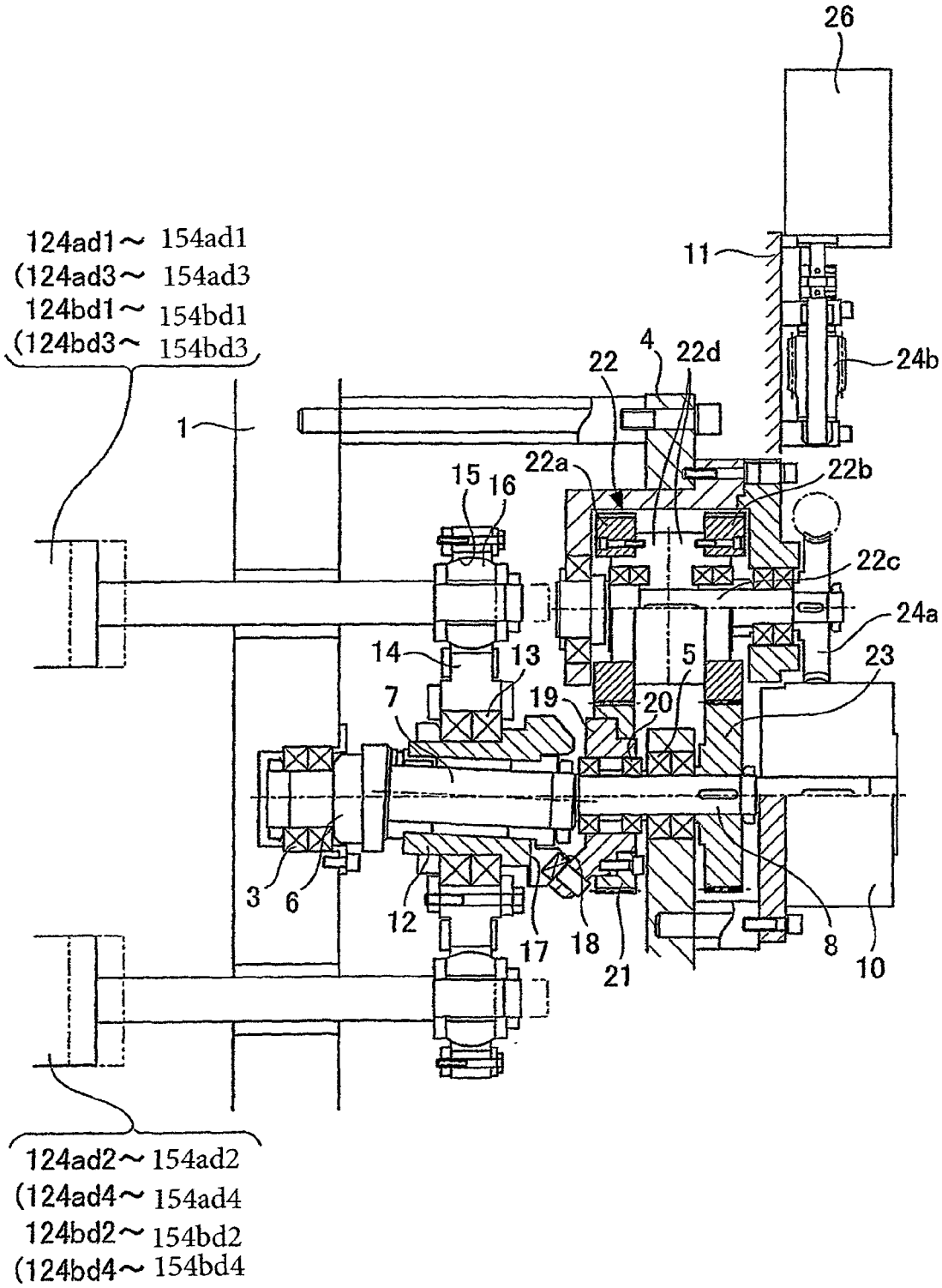
FIG. 6 is a schematic configuration diagram of an oscillation adjusting device for an oscillating roller of the offset printing unit of the security printing press in FIG. 1.

Specifically, as shown in FIG. 6, each of the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, and 124*bd*4 to 154*bd*4 is rotatably supported on the frame 1 with a shaft. A rotary shaft 6, which is rotatably supported by a bearing 3 provided in the frame 1 and a bearing 5 of a first support plate 4 screwed to the frame 1, is provided in a center portion substantially the same distance from the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, and 124*bd*4 to 154*bd*4.

The rotary shaft 6 includes an inclined shaft portion 7 and a parallel shaft portion 8 arranged adjacent to each other. The inclined shaft portion 7 is configured to be inclined to the axis of the oscillating roller 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4 while the parallel shaft portion 8 has an axis parallel to the axis of the oscillating roller 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4. At the parallel shaft portion 8, the rotary shaft 6 is supported on the first support plate 4 and is directly connected to an oscillation drive motor (first drive means, a dedicated motor) 10 incorporating a rotary encoder 9 (see FIG. 7), which is formed by a disk servo-motor or the like. The oscillation drive motor 10 is laterally attached to a second support plate 11 screwed to the first support plate 4.

A cylindrical sleeve 12, which has an outer peripheral surface inclined to the axis of the inclined shaft portion 7 of the rotary shaft 6, is fitted on the inclined shaft portion 7 in such a manner as to be rotatable but not movable in the axial direction. A disk (oscillating roller engagement member) 14 is supported on the outer peripheral surface of the sleeve 12 via a bearing 13 in such a manner as to be rotatable but not movable in the axial direction. A spherical body 16 provided on a shaft end of each oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4 is fitted to a spherical bearing (engaging portion) 15 provided on an outer peripheral portion of the disk 14.

A fitting groove (engaging portion) 17 is formed in a part of an outer periphery of the sleeve 12. A rotating member 19 having a fitting protrusion (engaged portion, such as a square pin, a round pin, a cam follower, or the like) 18 to be fitted into the fitting groove 17 is rotatably supported on the parallel shaft portion 8 of the rotary shaft 6 via a bearing 20.

An annular gear 21 is fitted on an outer periphery of the rotating member 19. An output gear 22*a* of a harmonic drive (registered trademark) device 22, serving as a differential mechanism, mounted on the first support plate 4 is in mesh with the annular gear 21. On the other hand, an input gear 22*b* of the harmonic drive (registered trademark) device 22 is in mesh with a disk-shaped gear 23 fixedly provided on the parallel shaft portion 8 of the rotary shaft 6. In addition, the rotation of an oscillation adjusting motor (second drive means, a dedicated motor) 26 incorporating a potentiometer 25 (see FIG. 7), which is vertically attached to the second support plate 11, is transmitted to a wave generator 22*c* of the harmonic drive (registered trademark) device 22 via a worm wheel 24*a* and a worm 24*b*.

The harmonic drive (registered trademark) device 22 is a known differential mechanism including, as basic elements: the wave generator 22*c*; a flex spline (not shown) fitted on an outer periphery of the wave generator 22*c*; and a pair of circular splines 22*d* in mesh with an outer periphery of the flex spline, in which the number of teeth of the circular splines 22*d* is two more than the number of teeth of the flex spline, and the output gear 22*a* is screwed into one of the circular splines 22*d* while the input gear 22*b* is screwed into the other circular spline 22*d*, and the reduction ratio is determined by the numbers of teeth of the flex spline and the circular splines 22*d*.

Accordingly, during normal operation, stopping the oscillation adjusting motor 26 transmits the rotation of the oscillation drive motor 10 to the disk-shaped gear 23 the harmonic drive (registered trademark) device 22 the annular gear 21 and the rotating member 19 in a ratio of 1:1, so that the sleeve 12, which rotates integrally with the rotating member 19, rotates at the same number of revolutions as that of the rotary shaft 6. On the other hand, rotating the oscillation adjusting motor 26 generates a slight difference in rotation between the disk-shaped gear 23, which is rotated by the oscillation drive motor 10, and the annular gear 21 and rotating member 19 due to the reduction action of the harmonic drive (registered trademark) device 22. The slight difference in rotation causes phase adjustment between the rotary shaft 6 (inclined shaft portion 7) and the sleeve 12, so that the oscillation of each oscillating roller 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4 is adjusted. After the adjustment, stopping the oscillation adjusting motor 26 causes the number of revolutions of the sleeve 12 to return to the initial number of revolutions (the same number of revolutions as that of the rotary shaft 6).

Figure 7:
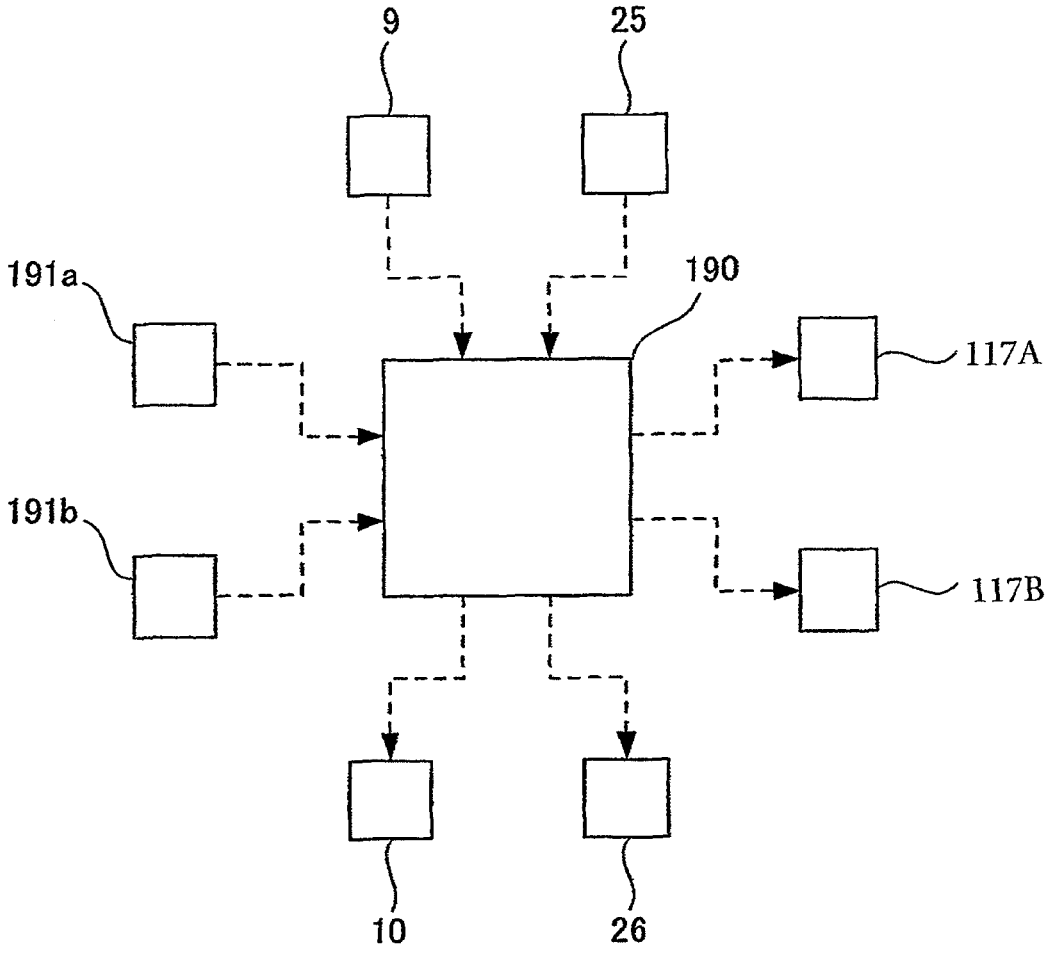
FIG. 7 is a control block diagram of the oscillation adjusting device and a sheet sorting device of the offset printing unit of the security printing press in FIG. 1.

Further, as shown in FIG. 7, the rotary encoder 9 and the potentiometer 25 are electrically connected to an input unit of a control device 190, which is control means. An output unit of the control device 190 is electrically connected to the motors 10 and 26. The control device 190 is thus capable of controlling the operations of the motors 10 and 26 on the basis of signals from the rotary encoder 9 and the potentiometer 25.

During normal operation, the oscillation adjusting device configured as described above rotates the oscillation drive motor 10 in a state where the oscillation adjusting motor 26 is stopped. This causes the sleeve 12 to rotate at the same number of revolutions as that of the rotary shaft 6 (inclined shaft portion 7) and the disk 14 to precess in conjunction with the precession of the inclined shaft portion 7, as described above. As a result, the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, and 124*bd*4 to 154*bd*4 are caused to oscillate in the axial direction sequentially at different phases and in a predetermined oscillation.

In this event, after initial position synchronization is performed between the initial position of the oscillation drive motor 10 and the initial position of the prime motor, the initial position of the oscillation drive motor 10 is shifted by a predetermined amount from the initial position of the prime motor, thereby adjusting the oscillation phase of each of the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, and 124*bd*4 to 154*bd*4 to a predetermined oscillation phase.

Then, under the above-described conditions, rotating the oscillation adjusting motor 26 causes a slight difference in rotation between the disk-shaped gear 23, which is rotated by the oscillation drive motor 10, and the annular gear 21 and rotating member 19 due to the action of the harmonic drive (registered trademark) device 22. The slight difference in rotation causes phase adjustment between the rotary shaft 6 (inclined shaft portion 7) and the sleeve 12, so that the oscillation of each oscillating roller 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4 is changed by the amount of rotation of the oscillation adjusting motor 26. As a result, the oscillation of the oscillating roller 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, or 124*bd*4 to 154*bd*4 is adjusted to the predetermined oscillation.

<<Sheet Sorting Device>>

In addition, as shown in FIG. 1, release cams 116A to 116C, which are release means for releasing gripper devices of the gripper bars of the delivery chain 114, are disposed near the delivery chain 114 on the respective delivery piles 115A to 115C of the delivery device 112. Elevating devices (see FIG. 7) 117A and 117B, such as air cylinders, which are approach and separation means, are coupled respectively to the two release cams 116A and 116B located closer to the delivery cylinder 113 among the release cams 116A to 116C. The elevating devices 117A and 117B are configured to move up and down to cause the corresponding release cams 116A and 116B to approach or separate from the delivery chain 114.

Moreover, a checking camera 191*a* for one surface, which is checking means for one surface for detecting a printing condition of one surface of the sheet 101, is disposed near the transport cylinder 174B of the second drying unit 170B, in other words, between a downstream side, in the transporting direction of the sheet 101, of a position (printing portion) where the impression cylinder 151*a* and the blanket cylinder 152*a* are in contact with each other in the offset printing section for one surface of the fourth offset printing unit 150, which is located on the most downstream side in the transporting direction of the sheet 101, and an upstream side, in the transporting direction of the sheet 101, of the impression cylinder 181 of the intaglio printing unit 180. In addition, a checking camera 191*b* for the other surface, which is checking means for the other surface for detecting a printing condition of the other surface of the sheet 101, is disposed near the transport cylinder 173B, in other words, between a downstream side, in the transporting direction of the sheet 101, of a position (printing portion) where the impression cylinder 151*b* and the blanket cylinder 152*b* are in contact with each other in the offset printing section for the other surface of the fourth offset printing unit 150, which is located on the most downstream side in the transporting direction of the sheet 101, and an upstream side, in the transporting direction of the sheet 101, of the impression cylinder 181 of the intaglio printing unit 180.

As shown in FIG. 7, the checking cameras 191*a* and 191*b* are electrically connected to the input unit of the control device 190. The output unit of the control device 190 is electrically connected to the elevating devices 117A and 117B. The control device 190 is thus capable of causing the elevating devices 117A and 117B to move up and down on the basis of signals from the checking cameras 191*a* and 191*b*.

<<Printing Operation>>

Next, an operation of the security printing press 100 according to the embodiment will be described.

When the sheet 101 is fed one by one from the sheet feeding device 110, the sheet 101 is transferred from the feeder board 111, the feedboard 112, and the swing arm shaft pregripper 113, through the transfer cylinder 120*a* of the first offset printing unit 120, to the impression cylinder 121*a*. As a result, the sheet 101 is held on the impression cylinder 121*a* with the one surface being on the front side.

The inks filled in the respective ink fountains 124*aa*1 and 124*aa*2 of the inking device 124*a* are taken out by the respective fountain rollers 124*ab*1 and 124*ab*2, and are transported to the roller train 124*ae* by the respective ink ductor rollers 124*ac*1 and 124*ac*2. Then, part of the inks is mixed into a rainbow state by the above-described reciprocating motions of the oscillating rollers 124*ad*1 to 124*ad*4 in the axial direction, and transported to the plate cylinder 123*a*. The ink is thus transferred onto the blanket cylinder 122*a* with a printing image corresponding to the pattern of the plate cylinder 123*a*.

Then, the sheet 101 passes between the impression cylinder 121*a* and the blanket cylinder 122*a*, and thereby the ink, which has been transferred in the rainbow state on the surface of the blanket cylinder 122*a*, is transferred onto one surface of the sheet 101 held on the peripheral surface of the impression cylinder 121*a*.

The sheet 101 with the one surface subjected to rainbow printing on the impression cylinder 121*a* is transported to and gripped on the impression cylinder 121*b*, so that the sheet is held on the impression cylinder 121*b* with the other surface being on the front side.

Moreover, the inks filled in the respective ink fountains 124*ba*1 and 124*ba*2 of the inking device 124*b* are taken out by the respective fountain rollers 124*bb*1 and 124*bb*2, and are transported to the roller train 124*be* by the respective ink ductor rollers 124*bc*1 and 124*bc*2. Then, part of the inks is mixed into a rainbow state by the above-described reciprocating motions of the oscillating rollers 124*bd*1 to 124*bd*4 in the axial direction, and transported to the plate cylinder 123*b*. The ink is thus transferred onto the blanket cylinder 122*b* with a printing image corresponding to the pattern of the plate cylinder 123*b*.

Then, the sheet 101 passes between the impression cylinder 121*b* and the blanket cylinder 122*b*, and thus the ink, which has been transferred in the rainbow state on the surface of the blanket cylinder 122*b*, is transferred onto the other surface of the sheet 101 held on the peripheral surface of the impression cylinder 121*b*.

The sheet 101 with the other surface subjected to rainbow printing on the impression cylinder 121*b* is transported to and gripped on the impression cylinder 131*a* of the second offset printing unit 130, so that the sheet is held on the impression cylinder 131*a* with the one surface being on the front side.

Successively, the sheet 101 is subjected to rainbow printing on the one surface and subjected to rainbow printing on the other surface in the second offset printing unit 130 in the same manner as the first offset printing unit 120, and then is transferred to the third printing unit 140.

Thereafter, the sheet 101 is subjected to the rainbow printing in the third and fourth offset printing units 140 and 150 in the same manner as the first offset printing unit 120. Thereafter, the sheet 101 is gripped on the transport cylinder 171Aa for one surface of the first drying unit 170A, and the ink on the one surface is dried by the dryer 172Aa for one surface while the sheet 101 is held and transported by the transport cylinder 171Aa with the one surface being on the front side. Then, the sheet 101 is gripped on the transport cylinder 171Ab for the other surface, and the ink on the other surface is dried by the dryer 172Ab for the other surface while the sheet 101 is held and transported by the transport cylinder 171Ab with the other surface being on the front side.

Next, the sheet 101 is gripped on the impression cylinder 161 of the screen printing unit 160. The sheet 101 is then subjected to screen printing on the one surface by the rotary screen 162 while being held and transported by the impression cylinder 161 with the one surface being on the front side. Thereafter, the sheet 101 is gripped on the transport cylinder 171Ba of the second drying unit 170B via the transport cylinder 163, and the ink screen-printed on the one surface of the sheet 101 is dried by the dryer 172Ba while the sheet 101 is held and transported by the transport cylinder 171Ba with the one surface being on the front side.

Subsequently, the sheet 101 is gripped on the transport cylinder 173B, and the printing condition of the other surface is detected by the checking camera 191*b* while the sheet 101 is held and transported by the transport cylinder 173B with the other surface being on the front side. Then, the sheet 101 is gripped on the transport cylinder 174B, and the printing condition of the one surface is detected by the checking camera 191*a* while the sheet 101 is held and transported by the transport cylinder 174B with the one surface being on the front side. Thereafter, the sheet 101 is gripped on the impression cylinder 181 of the intaglio printing unit 180 via the transfer cylinders 170Ba and 180*a*, so that the sheet 101 is held on the peripheral surface of the impression cylinder 181 with the other surface being on the front side.

The inks in the respective inking devices 185 are transferred to the ink collecting cylinder 183 via the ink form cylinders 184, and supplied to the intaglio cylinder 182. The excess of the inks is wiped out by the wiping roller 186 and cleaned and removed in the wiping tank 187.

Then, the sheet 101 passes between the impression cylinder 181 and the intaglio cylinder 182, and thereby the inks, which has been supplied to the intaglio plate of the intaglio cylinder 182, are transferred to the other surface of the sheet 101 held on the peripheral surface of the impression cylinder 181, and thereafter, the sheet 101 is held and transported by the gripper bar of the delivery chain 114 via the transport cylinder 170*a* of the delivery device 112.

The control device 190 judges whether or not the printing conditions of the one surface and the other surface of the sheet 101 are appropriate on the basis of signals from the checking cameras 191*a* and 191*b*. When judging that the printing conditions of both the one surface and the other surface of the sheet 101 are appropriate, the control device 190 activates one of the elevating devices 117A and 117B to cause a corresponding one of the release cams 116A and 116B to approach the delivery chain 114, and activates the other one of the elevating devices 117A and 117B to cause the corresponding other one of the release cams 116A and 116B to separate from the delivery chain 114.

In this way, the gripper device of the gripper bar of the delivery chain 114, which is holding and transporting the sheet 101, comes into contact with the one of the release cams 116A and 116B and is thus released, so that the sheet 101 is delivered and piled on a corresponding one of the delivery piles 115A and 115B (the delivery pile located below the one of the release cams 116A and 116B).

Once the number of sheets piled on the one of the delivery piles 115A and 115B as described above reaches a predetermined number, the control device 190 activates the other one of the elevating devices 117A and 117B to cause the corresponding other one of the release cams 116A and 116B to approach the delivery chain 114, and activates the one of the elevating devices 117A and 117B to cause the corresponding one of the release cams 116A and 116B to separate from the delivery chain 114.

In this way, the gripper device of the gripper bar of the delivery chain 114, which is holding and transporting the sheet 101, comes into contact with the other one of the release cams 116A and 116B and is thus released, so that the sheet 101 is delivered and piled on the other one of the delivery piles 115A and 115B (the delivery pile located below the other one of the release cams 116A and 116B). Accordingly, after the delivery pile to pile the sheets 101 is switched, the sheets 101 piled up to the predetermined number on the one of the delivery piles 115A and 115B can be carried out. Therefore, the printing products can be carried out without stopping the printing on the sheets 101.

On the other hand, when judging that the printing condition of any of the one surface and the other surface of the sheet 101 is not appropriate, the control device 190 activates the elevating devices 117A and 117B to cause the release cams 116A and 116B to separate from the delivery chain 114.

In this way, the sheet 101 held by the gripper device of the gripper bar of the delivery chain 114 passes through above the delivery piles 115A and 115B without being delivered onto the delivery piles 115A and 115B. Then, the gripper device comes into contact with the release cam 116C and is released, so that the sheet 101 is delivered on the delivery pile 115C and piled as a wasted sheet.

Therefore, the security printing press 100 according to the embodiment can provide the following advantageous effects.

(1) In each of the offset printing units 120, 130, 140, and 150, one surface of the sheet 101 held on the impression cylinder 121*a*, 131*a*, 141*a*, or 151*a* with the one surface being on the front side is subjected to offset printing by the blanket cylinder 122*a*, 132*a*, 142*a*, or 152*a*, and then, the other surface of the sheet 101, which is then gripped and held on the impression cylinder 121*b*, 131*b*, 141*b*, or 151*b* with the other surface being on the front side, is subjected to offset printing by the blanket cylinder 122*b*, 132*b*, 142*b*, or 152*b*. In short, the security printing press 100 employs alternate double-sided printing. Therefore, the sheet 101 is pressed against the blanket cylinders 122*a*, 132*a*, 142*a*, 152*a*, 122*b*, 132*b*, 142*b*, and 152*b* by the respective impression cylinders 121*a*, 131*a*, 141*a*, 151*a*, 121*b*, 131*b*, 141*b*, and 151*b*, making it possible to perform offset printing of sharp printing images on both surfaces of the sheet 101, and continuously perform intaglio printing on the sheet 101 in the intaglio printing unit 180 in line.

(2) The plate cylinders 123*a*, 123*b*, 133*a*, 133*b*, 143*a*, 143*b*, 153*a*, and 153*b* of the offset printing units 120, 130, 140, and 150 each include the plate clamping device 40 described in the aforementioned Patent Literature 5 and the like. Therefore, a printing plate, such as a resin plate or a PS plate, can be easily held detachably on the peripheral surface of each plate cylinder.

(3) The offset printing units 120, 130, 140, and 150 each include the printing plate mounting device described in the aforementioned Patent Literatures 6 and 7 and the like. Therefore, a printing plate, such as a resin plate or a PS plate, can be easily mounted on each of the plate cylinders 123*a*, 123*b*, 133*a*, 133*b*, 143*a*, 143*b*, 153*a*, and 153*b*, making it possible to significantly reduce the burden on the worker.

(4) In the offset printing units 120, 130, 140, and 150, the inking devices 124*a*, 134*a*, 144*a*, and 154*a* for one surface and the inking devices 124*b*, 134*b*, 144*b*, and 154*b* for the other surface each include the two ink fountains 124*aa*1 to 154*aa*1, 124*aa*2 to 154*aa*2, 124*ba*1 to 154*ba*1, 124*ba*2 to 154*ba*2, the fountain rollers 124*ab*1 to 154*ab*1, 124*ab*2 to 154*ab*2, 124*bb*1 to 154*bb*1, 124*bb*2 to 154*bb*2, the ink ductor rollers 124*ac*1 to 154*ac*1, 124*ac*2 to 154*ac*2, 124*bc*1 to 154*bc*1, 124*bc*2 to 154*bc*2, and the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, 124*bd*4 to 154*bd*4. In addition, the oscillating rollers 124*ad*1 to 154*ad*1, 124*ad*2 to 154*ad*2, 124*ad*3 to 154*ad*3, 124*ad*4 to 154*ad*4, 124*bd*1 to 154*bd*1, 124*bd*2 to 154*bd*2, 124*bd*3 to 154*bd*3, 124*bd*4 to 154*bd*4 are each configured such that the oscillation thereof can be adjusted by the oscillation adjusting device described in the aforementioned Patent Literature 8 and the like. Therefore, an ink distribution appropriate for rainbow printing can be easily obtained.

(5) The printing conditions of the one surface and the other surface of the sheet 101 with the one surface and the other surface subjected to printing are detected respectively by the checking cameras 191*a* and 191*b*. The control device 19 then controls the operations of the elevating devices 117A and 117B on the basis of signals from the checking cameras 191*a* and 191*b*, such that the sheets are sorted to be piled on the delivery piles 115A and 115B for appropriately printed sheets and the delivery pile 115C for wasted sheets. Therefore, the working efficiency can be improved.

(6) Each combination of the impression cylinder 121*a*, 121*b*, 131*a*, 131*b*, 141*a*, 141*b*, 151*a*, or 151*b* and the blanket cylinder 122*a*, 122*b*, 132*a*, 132*b*, 142*a*, 142*b*, 152*a*, or 152*b* is provided with the plate cylinder 123*a*, 123*b*, 133*a*, 133*b*, 143*a*, 143*b*, 153*a*, or 153*b* and the inking device 124*a*, 124*b*, 134*a*, 134*b*, 144*a*, 144*b*, 154*a*, or 154*b*. Accordingly, a space is provided between the plate cylinder 123*a*, 123*b*, 133*a*, 133*b*, 143*a*, 143*b*, 153*a*, or 153*b* and the inking device 124*a*, 124*b*, 134*a*, 134*b*, 144*a*, 144*b*, 154*a*, or 154*b* which are adjacent to each other. This eliminates the need for securing a working space for performing the printing preparation work or the maintenance and inspection work, such as the refilling of the ink, the cleaning of the rubber blanket, and the changing of the printing plate, thus allowing the work to be easily performed. In addition, since the plate cylinders 123*a*, 123*b*, 133*a*, 133*b*, 143*a*, 143*b*, 153*a*, and 153*b*, the inking devices 124*a*, 124*b*, 134*a*, 134*b*, 144*a*, 144*b*, 154*a*, or 154*b*, and the like are arranged side by side in the horizontal direction, this allows the worker to perform the work at ease. Therefore, the burden on the worker can be significantly reduced.

(7)

Each of the offset printing units 120, 130, 140, and 150 is configured of a module formed by providing each combination of the impression cylinder 121*a*, 131*a*, 141*a*, or 151*a* and the blanket cylinder 122*a*, 132*a*, 142*a*, or 152*a* for one surface and the impression cylinder 121*b*, 131*b*, 141*b*, or 151*b* and the blanket cylinder 122*b*, 132*b*, 142*b*, or 152*b* for the other surface with the corresponding plate cylinder 123*a*, 123*b*, 133*a*, 133*b*, 143*a*, 143*b*, 153*a*, or 153*b* and inking device 124*a*, 124*b*, 134*a*, 134*b*, 144*a*, 144*b*, 154*a*, or 154*b* and the like, and a plurality of the printing units are capable of being coupled and installed. Therefore, the maximum number of colors required for printing can be easily set by changing the number of units to be installed.

Other Embodiments

Figure 8:
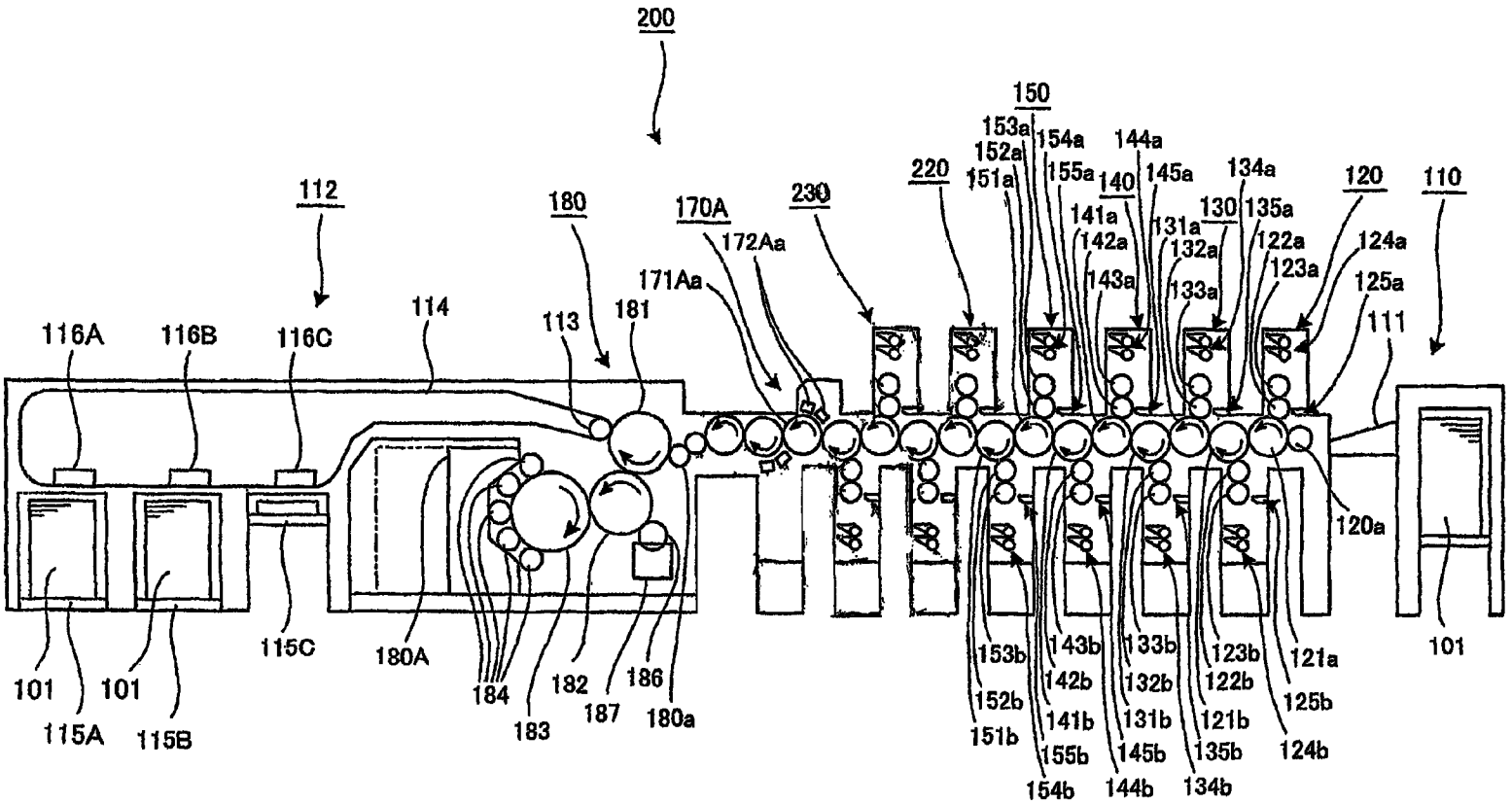
FIG. 8 is an overall schematic configuration diagram of another embodiment of the security printing press according to the present invention.
Figure 9:
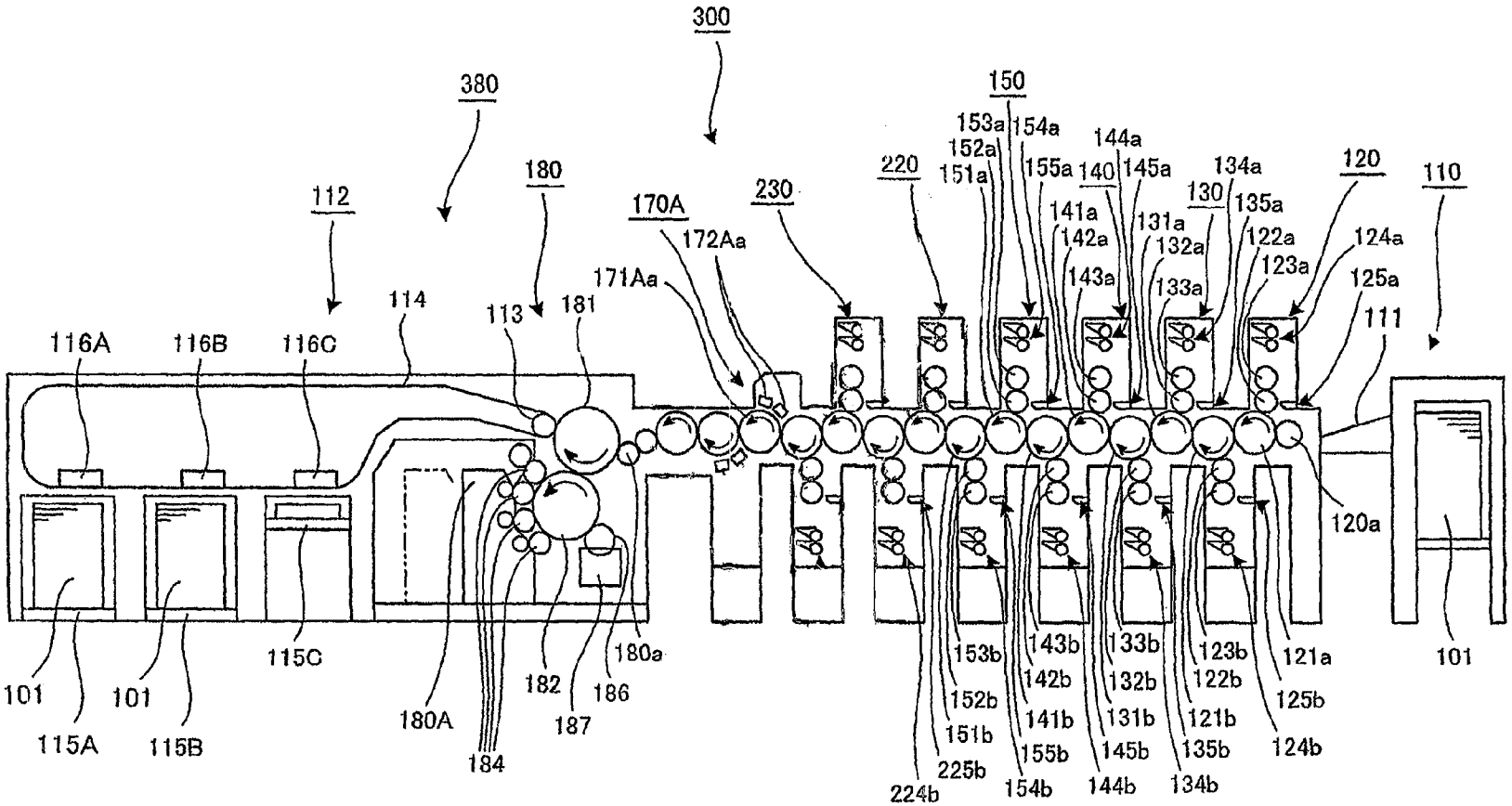
FIG. 9 is an overall schematic configuration diagram of still another embodiment of the security printing press according to the present invention.

Note that, in the above-described embodiment, description has been given to the security printing press 100 configured by including the four offset printing units (first to fourth offset printing units) 120, 130, 140, and 150, the first drying unit 170A, the screen printing unit 160, the second drying unit 170B, and the intaglio printing unit 180 including the ink collecting cylinder 183, the following is also possible as other embodiments. For example, it is possible to configure, as shown in FIG. 8, a security printing press 200 including: six offset printing units (first to six offset printing units) 120, 130, 140, 150, 220, and 230; a first drying unit 170A; and an intaglio printing unit 180 including an ink collecting cylinder 183 while omitting the screen printing unit 160 and the second drying unit 170B. Further, it is also possible to configure, as shown in FIG. 9, a security printing press 300 including: six offset printing units (first to six offset printing units) 120, 130, 140, 150, 220, and 230; a first drying unit 170A; and an intaglio printing unit 380 in which four ink form cylinders 184 are indirect contact with an intaglio cylinder 182 while omitting the ink collecting cylinder 183 of the intaglio printing unit 180.

Figure 10:
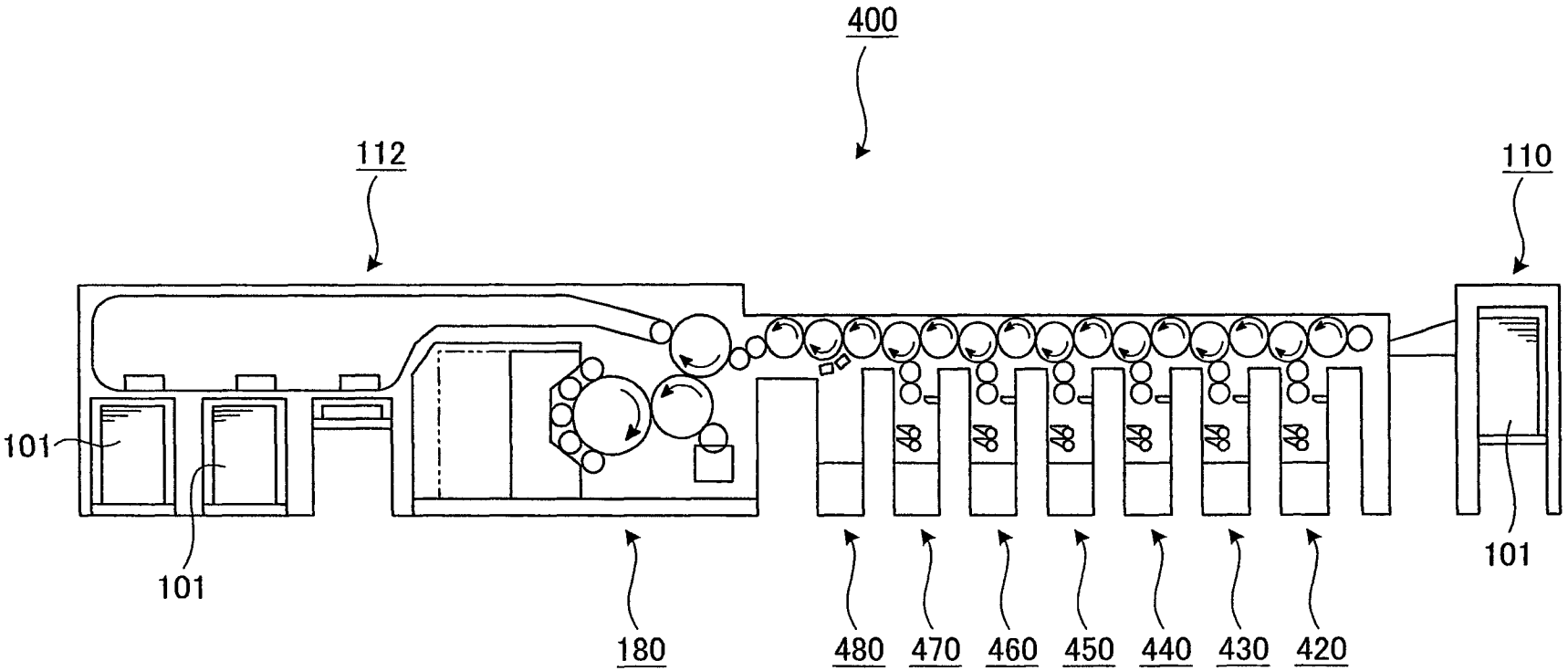
FIG. 10 is an overall schematic configuration diagram of yet another embodiment of the security printing press according to the present invention.

Moreover, in the above-described embodiments, description has been given to the security printing presses 100, 200, and 300 configured by including: the offset printing units 120, 130, 140, 150, 220, and 230 each including the offset printing section for one surface and the offset printing section for the other surface; and the first drying unit 170A, which dries both the one surface and the other surface of the sheet 101. Alternatively, for example, it is possible to configure, as shown in FIG. 10, a security printing press 400 including: offset printing units 420, 430, 440, 450, 460, and 470 each including only the offset printing section for the other surface; and a drying unit 480 which dries only the other surface of the sheet 101, which makes it possible to print securities requiring a printing image on only the other surface of the sheet 101.

INDUSTRIAL APPLICABILITY

The security printing press according to the present invention is capable of performing offset printing of sharp printing images on a sheet and continuously performing intaglio printing on the sheet in line, and accordingly is very useful to be utilized in the manufacture of banknotes such as bank bills and securities such as stock certificates and bond certificates.

REFERENCE SIGNS LIST

100 security printing press
101 sheet
110 sheet feeding device
111 feeder board
112 delivery device
113 delivery cylinder
114 delivery chain

115A to 115C delivery pile
116A to 116C release cam
117A, 117B elevating device
120 first offset printing unit
120*a* transfer cylinder for one surface
121*a* impression cylinder for one surface
122*a* blanket cylinder for one surface
123*a* plate cylinder for one surface
124*a* inking device for one surface
124*aa*1, 124*aa*2 ink fountain
124*ab*1, 124*ab*2 fountain roller
124*ac*1, 124*ac*2 ink ductor roller
124*ad*1 to 124*ad*4 oscillating roller
124*ae* roller train
125*a* dampening device for the other surface
120*b* transfer cylinder for the other surface
121*b* impression cylinder for the other surface
122*b* blanket cylinder for the other surface
123*b* plate cylinder for the other surface
124*b* inking device for the other surface
124*ba*1, 124*ba*2 ink fountain
124*bb*1, 124*bb*2 fountain roller
124*bc*1, 124*bc*2 ink ductor roller
124*bd*1 to 124*bd*4 oscillating roller
124*be* roller train
125*b* dampening device for the other surface
130 second offset printing unit
131*a* impression cylinder for one surface
132*a* blanket cylinder for one surface
133*a* plate cylinder for one surface
134*a* inking device for one surface
134*aa*1, 134*aa*2 ink fountain
134*ab*1, 134*ab*2 fountain roller
134*ac*1, 134*ac*2 ink ductor roller
134*ad*1 to 134*ad*4 oscillating roller
134*ae* roller train
135*a* dampening device for the other surface
130*b* transfer cylinder for the other surface
131*b* impression cylinder for the other surface
132*b* blanket cylinder for the other surface
133*b* plate cylinder for the other surface
134*b* inking device for the other surface
134*ba*1, 134*ba*2 ink fountain
134*bb*1, 134*bb*2 fountain roller
134*bc*1, 134*bc*2 ink ductor roller
134*bd*1 to 134*bd*4 oscillating roller
134*be* roller train
135*b* dampening device for the other surface
140 third offset printing unit
141*a* impression cylinder for one surface
142*a* blanket cylinder for one surface
143*a* plate cylinder for one surface
144*a* inking device for one surface
144*aa*1, 144*aa*2 ink fountain
144*ab*1, 144*ab*2 fountain roller
144*ac*1, 144*ac*2 ink ductor roller
144*ad*1 to 144*ad*4 oscillating roller
144*ae* roller train
145*a* dampening device for the other surface
140*b* transfer cylinder for the other surface
141*b* impression cylinder for the other surface
142*b* blanket cylinder for the other surface
143*b* plate cylinder for the other surface
144*b* inking device for the other surface
144*ba*1, 144*ba*2 ink fountain
144*bb*1, 144*bb*2 fountain roller
144*bc*1, 144*bc*2 ink ductor roller
144*bd*1 to 144*bd*4 oscillating roller
144*be* roller train
145*b* dampening device for the other surface
150 fourth offset printing unit
151*a* impression cylinder for one surface
152*a* blanket cylinder for one surface
153*a* plate cylinder for one surface
154*a* inking device for one surface
154*aa*1, 154*aa*2 ink fountain
154*ab*1, 154*ab*2 fountain roller
154*ac*1, 154*ac*2 ink ductor roller
154*ad*1 to 154*ad*4 oscillating roller
154*ae* roller train
155*a* dampening device for the other surface
150*b* transfer cylinder for the other surface
151*b* impression cylinder for the other surface
152*b* blanket cylinder for the other surface
153*b* plate cylinder for the other surface
154*b* inking device for the other surface
154*ba*1, 154*ba*2 ink fountain
154*bb*1, 154*bb*2 fountain roller
154*bc*1, 154*bc*2 ink ductor roller
154*bd*1 to 154*bd*4 oscillating roller
154*be* roller train
155*b* dampening device for the other surface
160 screen printing unit
161 impression cylinder
162 rotary screen
163 transport cylinder
170A first drying unit
171Aa transport cylinder for one surface
172Aa drier for one surface
171Ab transport cylinder for the other surface
172Ab drier for the other surface
170B second drying unit
170Ba transfer cylinder
171B transport cylinder
172B drier
173B, 174B transport cylinder
180 intaglio printing unit
180A frame
180*a* transfer cylinder
181 impression cylinder
182 intaglio cylinder
183 ink collecting cylinder
184 ink form cylinder
185 inking device
186 wiping roller
187 wiping tank
190 control device
191*a* checking camera for one surface
191*b* checking camera for the other surface
200 security printing press
220 fifth offset printing unit
230 sixth offset printing unit
300 security printing press
380 intaglio printing unit
400 security printing press
420 first offset printing unit
430 second offset printing unit
440 third offset printing unit
450 fourth offset printing unit
460 fifth offset printing unit
470 sixth offset printing unit
480 drying unit

The invention claimed is:

1. A security printing press for printing securities, comprising:

an offset printing unit including an impression cylinder which holds and transports a sheet, a blanket cylinder which is in contact with the impression cylinder, a plate cylinder which is in contact with the blanket cylinder, and ink supply means for supplying ink to the plate cylinder; and an intaglio printing unit including an impression cylinder which receives the sheet subjected to offset printing in the offset printing unit and holds and transports the sheet, an intaglio cylinder which is in contact with the impression cylinder, an ink collecting cylinder which is in contact with the intaglio cylinder, a plurality of ink form cylinders which are in contact with the ink collecting cylinder, and a plurality of inking devices which are disposed to respectively correspond to the ink form cylinders and which supply ink to the corresponding ink form cylinders, wherein the impression cylinder of the offset printing unit does not have a rubber blanket wound around a surface thereof, and wherein the offset printing unit is capable of performing offset printing of sharp printing images on the sheet by transferring ink, which is supplied from the ink supply means to the plate cylinder and transferred onto the blanket cylinder, onto the sheet held and transported on the impression cylinder, wherein the offset printing unit includes only one plate cylinder, and wherein the ink supply means of the offset printing unit includes two ink fountains.

2. The security printing press according to claim 1, wherein the offset printing unit includes:

an offset printing section for one surface including an impression cylinder for one surface which holds and transports the sheet, a blanket cylinder for one surface which is in contact with the impression cylinder for one surface and which performs offset printing on one surface of the sheet, a plate cylinder for one surface which is in contact with the blanket cylinder for one surface, and ink supply means for one surface for supplying ink to the plate cylinder for one surface; and an offset printing section for the other surface including an impression cylinder for the other surface which is in contact with the impression cylinder for one surface of the offset printing section for one surface and which receives the sheet from the impression cylinder for one surface and holds and transports the sheet, a blanket cylinder for the other surface which is in contact with the impression cylinder for the other surface and which performs offset printing on the other surface of the sheet, a plate cylinder for the other surface which is in contact with the blanket cylinder for the other surface, and ink supply means for the other surface for supplying ink to the plate cylinder for the other surface, and each of the ink supply means for one surface of the offset printing section for one surface and the ink supply means for the other surface of the offset printing section for the other surface includes: the two ink fountains; an oscillating roller; and oscillation adjusting means for adjusting oscillation of the oscillating roller.

3. The security printing press according to claim 2, further comprising:

at least one sheet forwarding cylinder which is disposed between the offset printing unit and the impression cylinder of the intaglio printing unit and which forwards the sheet subjected to offset printing in the offset printing unit to the impression cylinder of the intaglio printing unit.

4. The security printing press according to claim 2, wherein the offset printing unit is configured as one module formed of the offset printing section for one surface and the offset printing section for the other surface, and a plurality of the offset printing units are capable of being coupled.

5. The security printing press according to claim 2, further comprising:

checking means for one surface for detecting a printing condition of the one surface of the sheet, the checking means for one surface being disposed between a downstream side, in a transporting direction of the sheet, of a printing portion in the offset printing section for one surface that is located on the most downstream side in the transporting direction of the sheet and an upstream side, in the transporting direction of the sheet, of the impression cylinder of the intaglio printing unit, and checking means for the other surface for detecting a printing condition of the other surface of the sheet, the checking means for the other surface being disposed between a downstream side, in the transporting direction of the sheet, of a printing portion in the offset printing section for the other surface that is located on the most downstream side in the transporting direction of the sheet and an upstream side, in the transporting direction of the sheet, of the impression cylinder of the intaglio printing unit.

6. The security printing press according to claim 2, further comprising:

plate changing means for one surface for changing a printing plate for the plate cylinder for one surface, the plate changing means for one surface being provided in the offset printing section for one surface; and plate changing means for the other surface for changing a printing plate for the plate cylinder for the other surface, the plate changing means for the other surface being provided in the offset printing section for the other surface.

* * * * *